US007543554B2

(12) United States Patent
Kruger et al.

(10) Patent No.: US 7,543,554 B2
(45) Date of Patent: Jun. 9, 2009

(54) TWO-STROKE MOTOR WITH AN IMPROVED TRANSFER PORT

(75) Inventors: Markus Kruger, Weede (DE); Harry Radel, Geesthacht (DE)

(73) Assignee: Dolmar GmbH, Hamburg (DE)

( * ) Notice: Subject to any disclaimer, the term of this patent is extended or adjusted under 35 U.S.C. 154(b) by 30 days.

(21) Appl. No.: 11/847,157

(22) Filed: Aug. 29, 2007

(65) Prior Publication Data

US 2008/0110446 A1 May 15, 2008

(30) Foreign Application Priority Data

Aug. 30, 2006 (DE) ..... 20 2006 013 285 U

(51) Int. Cl.
*F02B 25/00* (2006.01)

(52) U.S. Cl. ..... 123/73 PP; 123/65 P

(58) Field of Classification Search ..... 123/65 A, 123/65 P, 73 PP

See application file for complete search history.

(56) References Cited

U.S. PATENT DOCUMENTS 2,406,404 A 8/1946 Ryde
3,494,335 A * 2/1970 Meier ..... 123/65 R
4,051,820 A 10/1977 Boyesen

FOREIGN PATENT DOCUMENTS

| | | | |
|---|---|---|---|
| DE | 822 316 | | 11/1951 |
| DE | 102 23 069 | A1 | 5/2002 |
| DE | 1 574 683 | A1 | 12/2003 |
| DE | 102005019520 | A1 | 4/2005 |

* cited by examiner

*Primary Examiner*—Noah Kamen
(74) *Attorney, Agent, or Firm*—Kelly Lowry & Kelley, LLP

(57) ABSTRACT

In order to provide a two-stroke motor, in particular for a portable, hand-guided working device with a combustion space formed in a cylinder and a piston guided in the cylinder so that it performs a lifting movement, at least one transfer port is provided which is formed at least from a combustion-space-side opening section, a rising section and a crankcase-space-side inlet section. The opening section is connected to the inlet section by the rising section arranged approximately parallel to the piston barrel. The motor has a small flow resistance because of its geometric design, despite maintaining small opening windows into the combustion space, and allows simple casting production. The transfer port forms in the inlet section a whole port which passes in a single-flow manner into the rising section and is divided by a division at least into a first partial port and a second partial port at least in the upper region of the rising section adjoining the opening section.

13 Claims, 4 Drawing Sheets

TWO-STROKE MOTOR WITH AN IMPROVED TRANSFER PORT

TECHNICAL FIELD

This invention relates to a two-stroke motor, in particular for a portable, hand-guided working device such as a motor chain saw, a motor scythe, a parting-off grinder or the like, with a combustion space formed in a cylinder, which space is bounded by a piston guided in the cylinder so that it performs a lifting movement, which piston drives a crankshaft rotatably mounted in a crankcase space by means of a connecting rod, where at least one transfer port is provided which, in predetermined piston positions, connects the crankcase space in a fluidic manner, and where the transfer port is formed at least from a combustion-space-side opening section, a rising section and a crankcase-space-side inlet section, the opening section being connected to the inlet section by the rising section arranged approximately parallel to the piston barrel.

Two-stroke motors, such as those used in the above-mentioned devices, are characterised by one or a plurality of transfer ports through which the fuel-air mixture is fed from the crankcase space into the combustion space. The fuel-air mixture flowing through the crankcase space also simultaneously lubricates the crank mechanism due to the addition of a proportion of lubricating oil, where the crankcase space also comprises a feed port through which the two-stroke mixture is fed.

STATE OF THE ART

A known state of the art is described in detail in the following detailed figure description (see FIGS. 4*a* and 4*b*), with its advantages and disadvantages, thus they are not discussed in further detail at this point.

European patent application EP 1 574 683 A1 discloses a two-stroke motor with a transfer port which is divided into a first partial port and a second partial port. It can be seen here that the division into the first partial port and the second partial port extends through the opening section and through the entire rising section into the inlet section.

DE 102 23 069 A1 also discloses a two-stroke motor, in particular in a portable, hand-guided working device with a combustion space formed in a cylinder, which space is delimited by a reciprocating piston. The two-stroke motor has a transfer port which, in established piston positions, connects the crankcase to the combustion space. According to this embodiment the transfer port is also divided into a first transfer port and a second transfer port, the division extending throughout the transfer port.

In the embodiments of transfer ports of prior art the problem arises that the production design of cast components with ports which have a small flow cross-section, often suffers from major technical difficulties. To achieve the maximum scavenging cross-section for the combustion space, two partial transfer ports or even three partial transfer ports are often provided on each side. When a plurality of transfer ports are arranged on each cylinder side, the problem arises, for producing the casting mould, that a multiplicity of small ports extending over a long length has to be provided. However, a disadvantage of this design is that the cross-section of the transfer ports along the cylinder circumference cannot be substantially enlarged, otherwise the window opening into the combustion space in the region of the opening section becomes too large and the piston rings may possibly jar or catch. A further problem is that the design with small, very slim ports, results in considerable pressure losses, which hinders the supply of cylinder charge in the combustion space.

REPRESENTATION OF THE INVENTION

Object, Solution, Advantages

The object of this invention is therefore to provide a two-stroke motor with at least one transfer port which, because of its geometric design, has a low flow resistance despite maintaining small opening windows into the combustion space, and allows simple production from the casting point of view.

This object is achieved on the basis of a two-stroke motor with the features according to claim 1. Advantageous further developments of the invention are described in the dependent claims.

The invention embodies the technical theory that the transfer port in the inlet section forms a whole port which passes in a single-flow manner into the rising section and is divided at least into a first partial port and a second partial port in the upper region of the rising section adjacent to the opening section.

The basic concept of the invention is the provision of a transfer port which allows simple casting production. The simplification of the casting production arises from the single-flow port which extends from the inlet section essentially throughout the rising section, so that the division of the single-flow port into a first partial port and a second partial port does not occur until the upper flow end in the direction of the combustion space. There it is still possible, even in the case of a large total cross-section, to avoid large area openings into the combustion space, thus obviating the problem of jarring or catching of the piston rings in the opening. In this case the whole port forms a single-flow cross-section which comprises at least the total cross-section of the first partial port and the second partial port. The rising section arranged essentially parallel to the piston barrel requires only one solid core, the division into the first and second partial port only being provided in the upper end region of the rising section.

According to an advantageous embodiment of the invention provision is made for the opening section to pass via a deflection region into the rising section. Furthermore, the direction of extension of the upper inlet section and the direction of extension of the rising section form an angle of 70° to 110°, preferably an angle of 80° to 100°, and in particular preference an angle of 85° to 90°. All these angle values also relate to the directions of extension of the rising section relative to the direction of extension of the opening section, so that all the openings of the inlet section and of the opening section point in the same direction.

According to a further advantageous embodiment the division commences in the region of the rising section adjoining the deflection region, so that it divides the transfer port into the first and second partial ports only in the deflection region and in the opening section. The deflection region separates the horizontal course of the inlet section from the vertical course of the rising section, the division according to this embodiment commencing in the region of the transition of the rising section into the deflection region, the deflection region and the opening section only being divided after the division into the first and second partial ports has taken place. It is also possible for the division to commence inside the deflection section.

According to a further embodiment the division does not commence until the opening section adjoining the deflection region, so that it divides the transfer port into a first and second partial port only in the region of the inlet section adjoining the combustion space. The division commences in these various exemplary embodiments in the course of the flow direction, i.e. commencing from the inlet section via the rising section and as far as the opening section, following later, so that according to the last-mentioned exemplary embodiment the division does not commence until the horizontally running opening section adjoining the combustion space. Here the division may take place over a short section in such a manner that a type of bridge is formed to avoid too great a window through the opening of the inlet section into the combustion space so that the transfer port is designed essentially in a single-flow manner, and has a division only in the last partial region of the inlet section lying in the direction of flow.

The two-stroke motor can be advantageously designed for operation according to the air receiving principle, so that at least one clean air port is provided which is connected in a fluidic manner to the transfer port. When a two-stroke motor is operated according to the air receiving principle, charging air is received before the fuel-air-air layer is supplied in order to prevent unburnt fuel from escaping from the two-stroke motor. For this a clean air port is provided which extends to the side of the actual transfer port. The opening of the clean air port into the transfer port may take place level with the deflection region. This provides the possibility of distributing clean air throughout the flow cross-section of the transfer port by supplying clean air through a laterally arranged clean air port, with the result that the clean air is supplied to the combustion space not merely through the first or second partial port.

This invention also extends to a casting mould for producing a transfer port in a two-stroke motor, where the casting mould, for the purpose of forming the transfer port in the inlet section, forming a whole port which passes in single-flow manner into the rising section and is divided into at least a first partial port and a second partial port at least in the upper region of the rising section adjoining the opening section. The casting mould according to the invention for producing a transfer port in a two-stroke motor also comprises the casting mould for producing a cylinder for a two-stroke motor in which at least one transfer port according to the invention is formed. In this case the casting mould has a core which has the single-flow guide through the inlet section and through the majority of the rising section or even the inlet section.

According to a further embodiment of the casting mould provision is made for the upper opening section to pass via a deflection region of the casting mould into the rising section, where the division commences in the region of the rising section adjoining the deflection region and the deflection region and opening section are formed by the first and second partial ports. Each section and the deflection region have suitable casting-typical radii, the division itself also having a round contour to optimise the flow behaviour.

According to a further exemplary embodiment of the casting mould the division commences in the opening section adjoining the deflection region, so that this divides the opening section into a first and second partial ports only in the region adjoining the combustion space. The division made only in the region of the inlet section adjoining the combustion space should, however, have a minimum thickness in order not to drop below the minimum casting cross-section required for a bridge formed in this manner.

According to a further advantageous exemplary embodiment provision is made for the casting mould to be designed as a sand mould for a gravity casting process, two transfer ports being provided in the cylinder of the two-stroke motor. In the case of a sand mould in particular, larger inner ports are advantageous because it is easier to remove the cast cylinder from the sand mould. The larger the inner flow cross-section formed the more easily will be the separation of the moulding from the sand mould.

BRIEF DESCRIPTION OF THE DRAWINGS

Further measures improving the invention are indicated in the dependent claims or are explained in the following together with the description of preferred exemplary embodiments of the invention with reference of the figures. In purely diagrammatic form

BEST METHOD OF IMPLEMENTING THE INVENTION

Figure 4B:
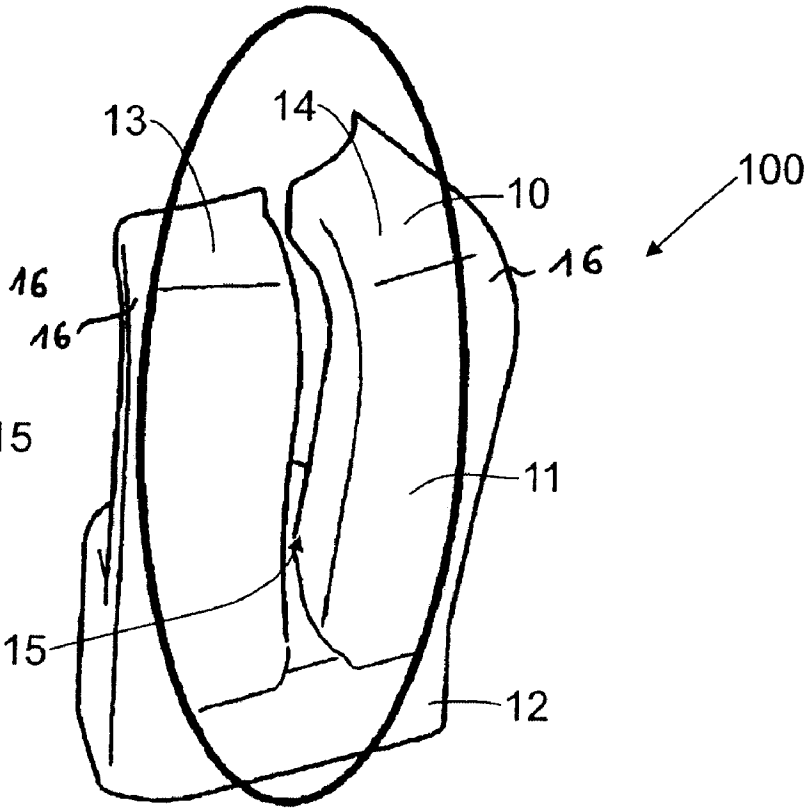
Fig. 4b PRIOR ART
FIG. 4*b* shows a further perspective view of the embodiment of a transfer port according to the state of the art shown in FIG. 4*a*.
Figure 4A:
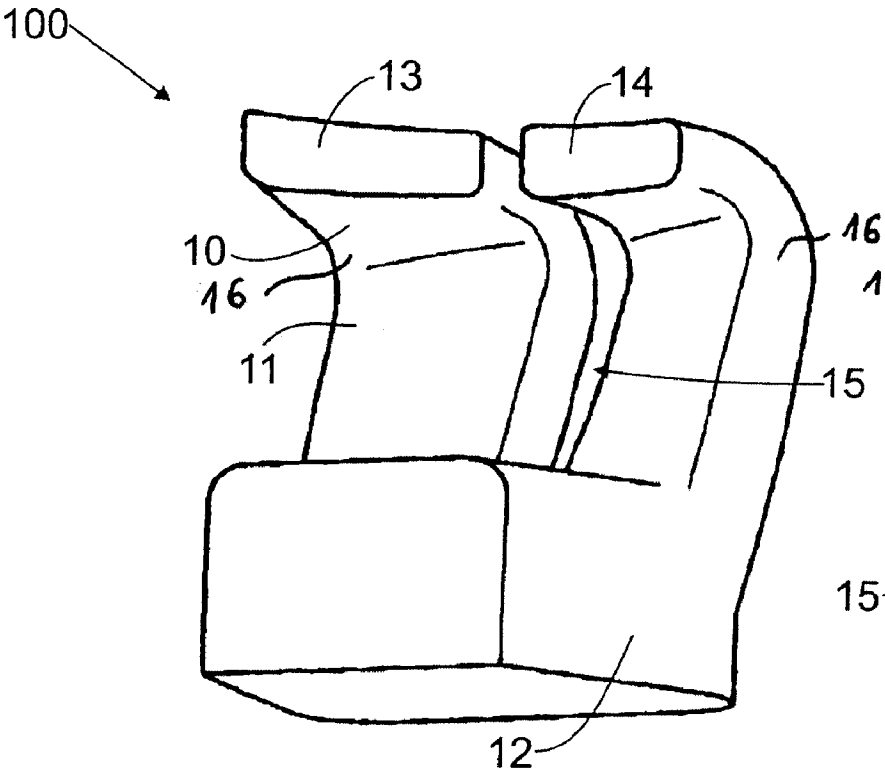
Fig. 4a PRIOR ART
FIG. 4*a* shows a perspective view of a transfer port according to the state of the art.

FIGS. 4*a* and 4*b* show a transfer port 100 from the state of the art. Transfer port 100 is designed as a channel-shaped cavity inside the cylinder wall of the two-stroke motor. FIGS. 4*a* and 4*b* therefore represent the envelope body of the cavity incorporated in the cylinder. Transfer port 100 is formed from three sections which are divisible into an opening section 10 which opens directly into the combustion space of the cylinder. This space is connected to a rising section 11 which extends essentially parallel to the direction of piston lifting movement inside the cylinder. This section passes into an inlet section 12 which opens into the crankcase space of the two-stroke motor. A fluidic connection is therefore made in order to conduct the fuel-air mixture from the crankcase space into the combustion space. The respective directions of extension of the sections are approximately 90° to each other, so that the transfer port between opening section 10 and rising section 11 forms an angle of approximately 90° and rising section 11 and inlet section 12 also form an angle of approximately 90°. The respective openings of inlet section 10 and opening section 12 therefore point in the same direction.

Opening section 10 opens directly in the guide face of the cylinder which guides the piston. In most embodiments of reciprocating piston motors the piston comprises so-called piston rings which slide over the cylinder wall and seal the sliding guide between the piston and the cylinder. Here the piston rings are subjected to a pretension directed radially outwards and, if the opening of the inlet section in the combustion space wall has too large an area, be pushed into the inlet section. During a lifting movement of the piston rings they may catch or jar inside the windows formed by the opening section. A bridge is therefore provided inside the opening of opening section 10 so that opening section 10 is divided into a first partial port 13 and a second partial port 14. The division into the first and second partial ports 13 and 14 begins with a division 15 which is provided in inlet section 12 or at least in the region of this section. The entire rising section 11 and the subsequent opening section 10 therefore already run in a two-flow manner in the form of the first and second partial ports 13 and 14, which is expensive to achieve from the production point of view.

Variants of transfer port 100 according to the invention are shown in FIGS. 1*a* to 3, transfer port 100 corresponding to the envelope body of the transfer port, which is incorporated inside the cylinder wall in a two-stroke motor. This means that the representations in the figures each correspond to the core to provide a cavity inside the cylinder of the two-stroke motor, which the design shown has.

Figure 1B:
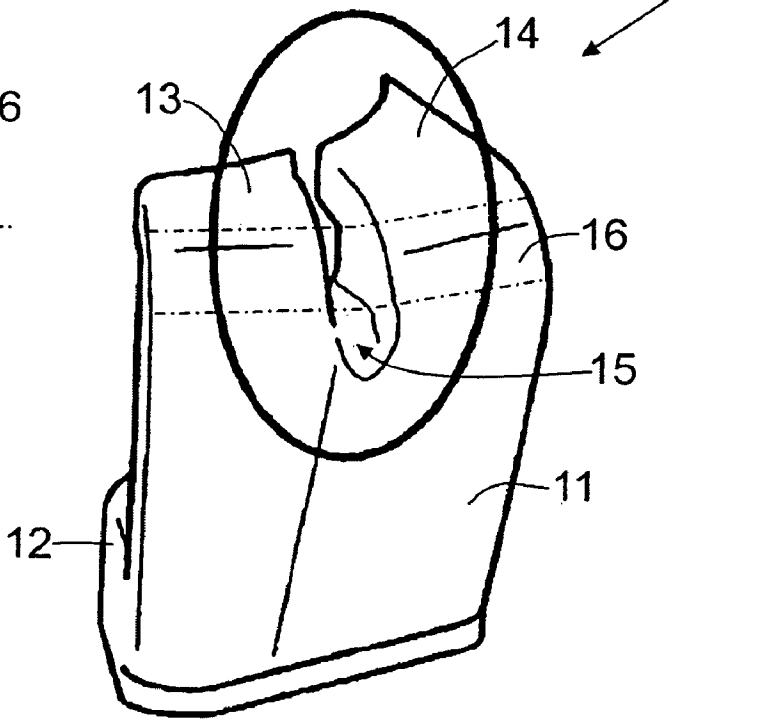
FIG. 1*b* shows a second perspective view of the embodiment of the transfer port in FIG. 1*a;*
Figure 1A:
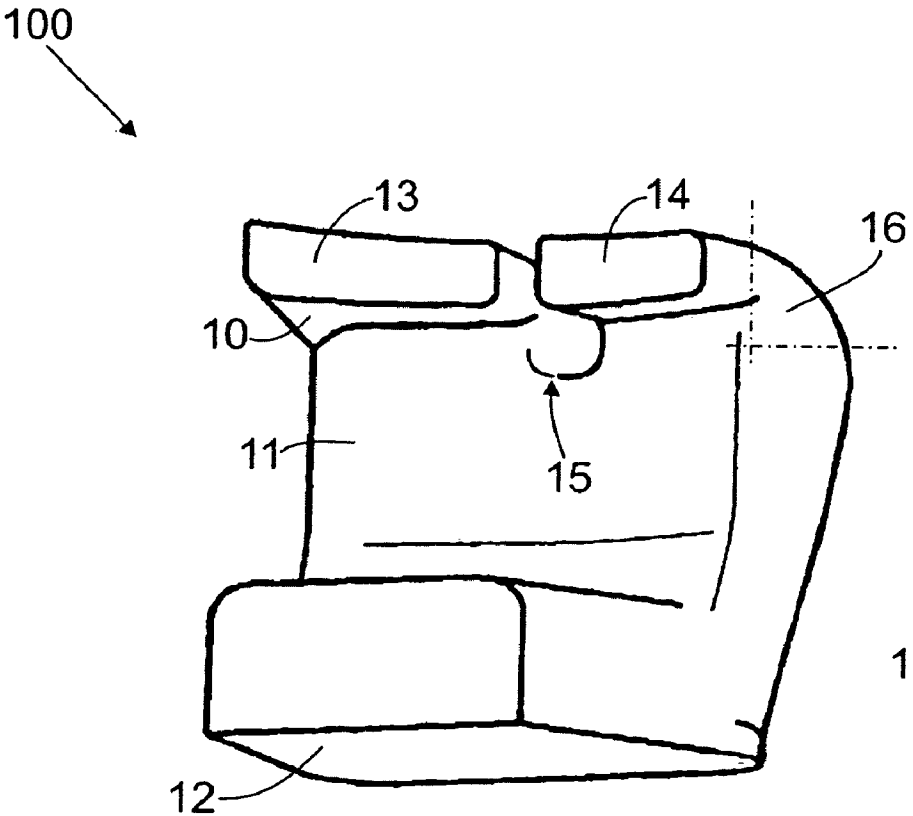
FIG. 1*a* shows a first perspective view of an embodiment of a transfer port according to this invention, the division commencing before the deflection region.

Transfer port 100 in FIGS. 1*a* and 1*b* has an opening section 10 which essentially comprises a direction of extension at right angles to a rising section 11. Rising section 11 is arrange din the vertical and is aligned approximately parallel to the direction of movement of the piston guided in the cylinder. Rising section 11 passes into an inlet section 12, which opens into the crankcase space, not shown here either. A fluidic connection between the crankcase space and the combustion space of the two-stroke motor is therefore formed by transfer port 100. This may be formed, in a distributed manner, on the circumference of the cylinder of the two-stroke motor, at least singly, preferably doubly or even multiply. Transfer port 100 forms a single-flow port in inlet section 12 and passes in a single-flow manner into rising section 11. A division 15 only takes place in the upper end region of rising section 11, so that a first partial port 13 and a second partial port 14 are formed. Opening section 10 is connected by a deflection region 16 to rising section 11, so that division 15 is arranged in the direction of flow even before deflection region 16. As a result, transfer port 100 is formed both in deflection region 16 and in the region of opening section 10 in a two-flow manner.

Figure 2B:
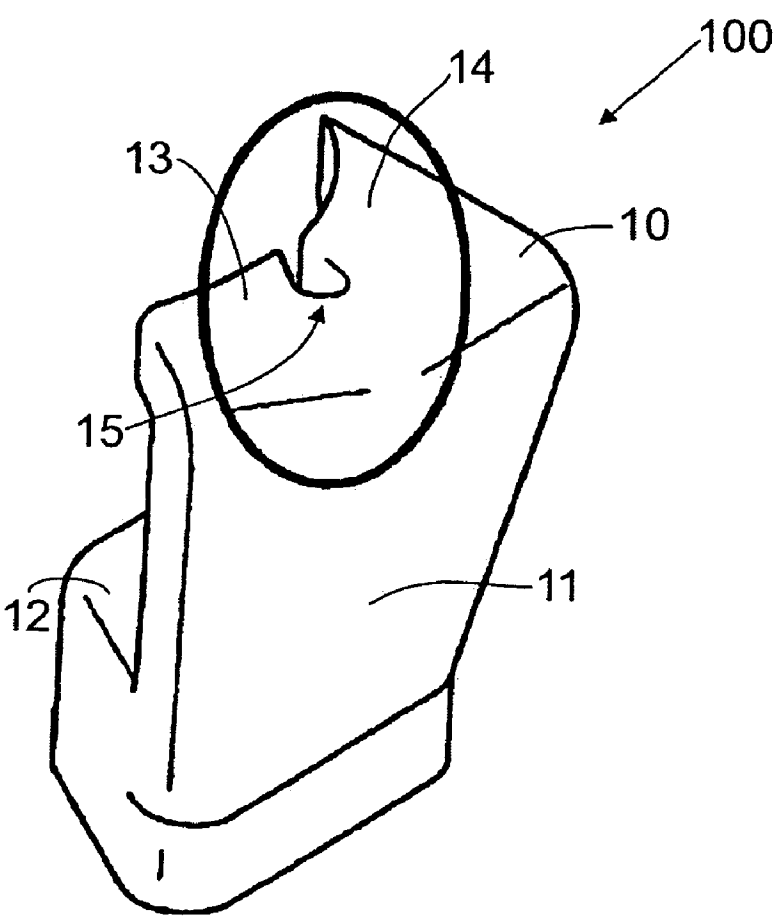
FIG. 2*b* shows a further perspective view of the exemplary embodiment of a transfer port according to FIG. 2*a;*
Figure 2A:
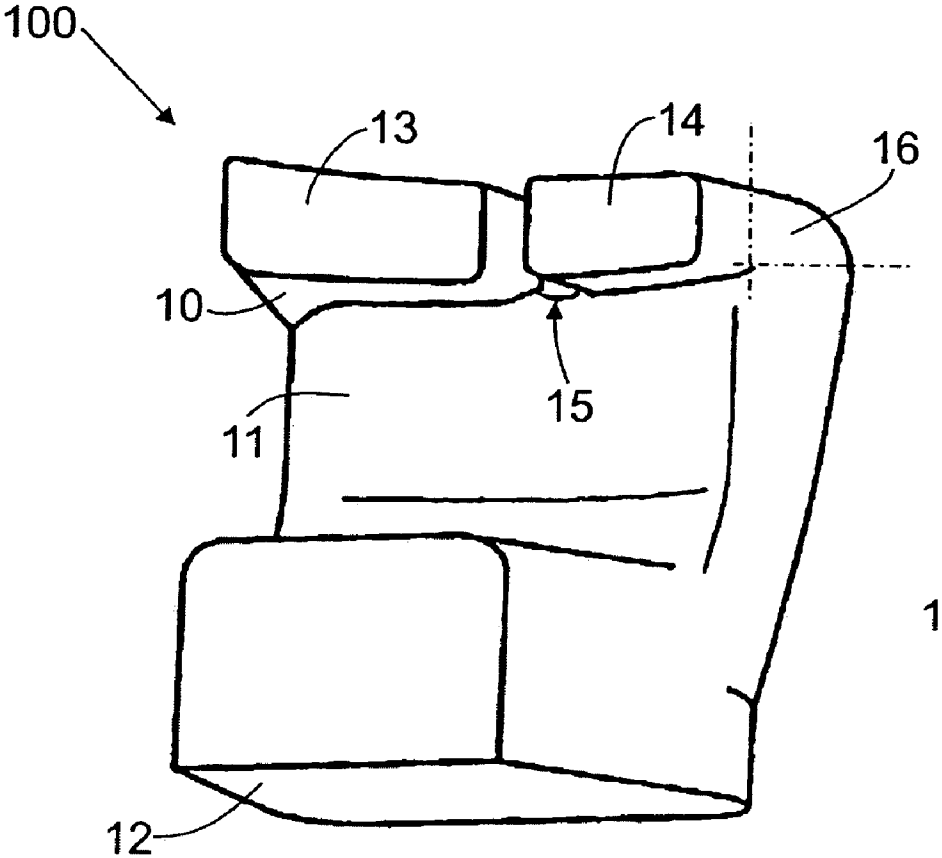
FIG. 2*a* shows a perspective view of a second embodiment of a transfer port according to this invention, the division not commencing until after the deflection region in the region of the inlet section.

FIGS. 2*a* and 2*b* show two different perspective views of a transfer port 100 according to a second exemplary embodiment of this invention. Transfer port 100 comprises initially inlet section 12, according to the direction of flow, which section passes into rising section 11 and finally ends in opening section 10. Division 15 takes place according to this exemplary embodiment after deflection region 16, i.e. inside inlet section 10. The exact arrangement of division 15 is shown in FIG. 2*b*, which illustrates that this division is provided inside inlet section 10 in the vicinity of the opening to the combustion space. Partial ports 13 and 14 are therefore of a very short construction, so that only one bridge is provided between the two partial ports 13 and 14. The transition from opening section 10 to rising section 11 via deflection region 16 may take place in a flowing manner so that a division into the respective sections is not clearly apparent from the actual geometrical shape. Nevertheless the concept of this invention extends to providing the beginning of division 15 as late as possible in the direction of flow so that this results in too short a design of first partial port 13 and partial port 14. This results in a section of a single-flow port inside transfer port 100 that is as long as possible.

Figure 3:
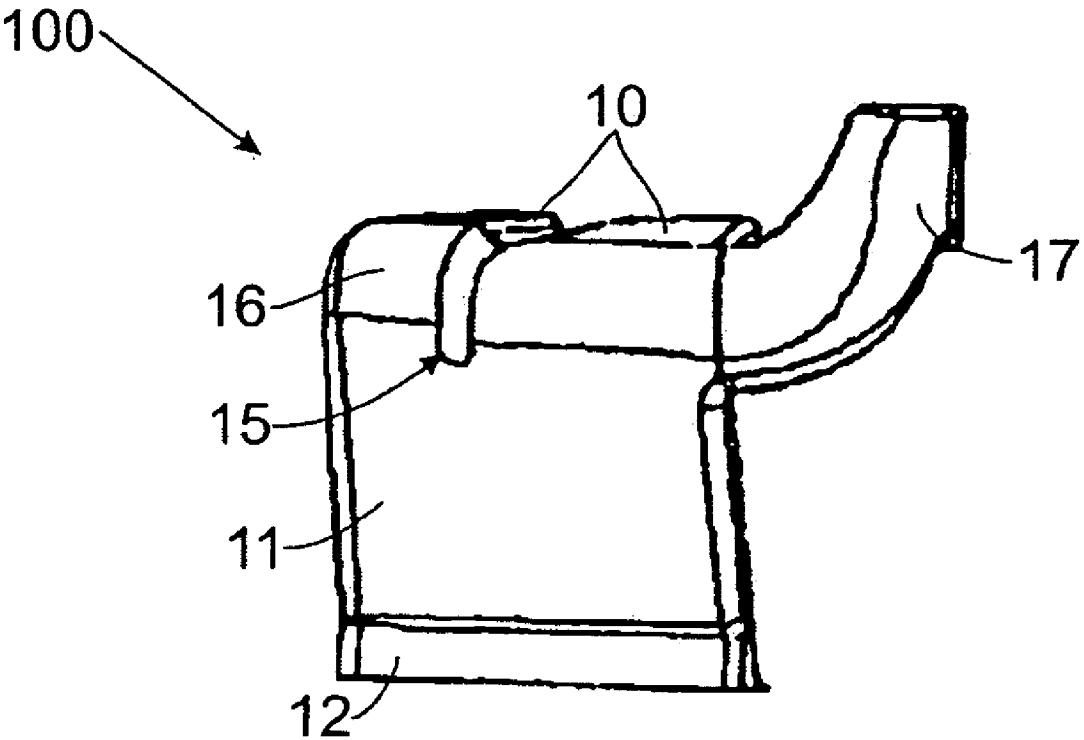
FIG. 3 shows a perspective view of a transfer port with a clean air port formed laterally on it.

According to the representations of transfer port 100 in FIG. 3, a clean air port 17 is provided, in addition to opening section 10, rising section 11 and inlet section 12, which clean air port opens into deflection region 16. The clean air port serves to supply receiving air for air receiving cylinders which may be designed, for example, as a reed valve controlled air receiving cylinder. According to the representation of division 15, this begins before opening section 10, where one embodiment of a transfer port 100, with a clean air port 17, may also comprise a division 15, which are designed according to the embodiment shown in FIG. 2 as regions of opening section 10 adjoining the combustion space.

This invention is not limited in its designs to the referred exemplary embodiments indicated above. On the contrary a multiplicity of variants is conceivable, these variants also making use of the solution represented even when they have fundamentally different designs. Provision may therefore be made, for example, for transfer port 100 to comprise at least two divisions 15 in the direction of flow, so that both a first partial port, a second partial port and a third partial port are formed. The final section inside inlet section 10 would therefore be three-flow in nature, this embodiment not departing from the concept of this invention. It is also possible to provide two clean air ports 17 which open both on the left and right sides into the actual flow port of transfer port 100. The opening may take place both in deflection region 16 and may also be provided inside opening section 10 or rising section 11 or inlet section 12.

The invention claimed is:

1. A two-stroke motor, in particular for a portable, hand-guided working device such as a motor chain saw, a motor lawnmower, a parting-off grinder or the like, with a combustion space formed in a cylinder bounded by a piston guided in the cylinder so that it performs a lifting movement, which piston drives a crankshaft rotatably mounted in a crankcase space by means of a connecting rod, comprising:

at least one transfer port which connects the crankcase space to the combustion space in predetermined piston positions in a fluidic manner, wherein the transfer port is formed at least from a combustion-space-side opening section, a rising section and a crankcase-space-side inlet section, and wherein the opening section is connected to the inlet section by the rising section arranged approximately parallel to the piston cylinder;

characterised in that the transfer port forms in the inlet section a whole port which passes in a single-flow manner into the rising section and is divided by a division at least into a first partial port and into a second partial port at least in the region of the rising section adjoining the opening section, wherein the division commences behind the deflection region in the opening section so that it divides the transfer port into a first and second partial port only in the region of the opening section adjoining the combustion space.

2. The two-stroke motor according to claim 1, characterised in that the opening section passes via a deflection region into the rising section.

3. The two-stroke motor according to claim 1, characterised in that the direction of extension of the upper opening section and the direction of extension of the rising section form an angle of 70° to 110°, preferably an angle of 80° to 100°, and in particular preference an angle of 85° to 90 °.

4. The two-stroke motor according to claim 1, characterised in that the division commences in the region of the rising section adjoining the deflection region so that it divides the transfer port into the first and second partial ports only in the deflection region and in the opening section.

5. The two-stroke motor according to claim 1, characterised in that the two-stroke motor is designed for an operation according to the air receiving principle, and in that at least one clean air port is provided which is connected to the transfer port in a fluidic manner.

6. A casting mould for producing a transfer port in a two-stroke motor according to claim 1, characterised in that forming the transfer port in the inlet section forms a whole port which passes in a single-flow manner into the rising section and is divided into a first partial port and a second partial port by a division at least in the upper region of the rising section adjoining the opening section.

7. The casting mould according to claim 6, characterised in that the upper opening section passes via a deflection region of the casting mould into the rising section, wherein the division commences in the region of the rising section adjoining the deflection region and in that the deflection region and the opening section are formed by the first and second partial ports

8. The casting mould according to claim 6, characterised in that the division commences behind the deflection region commences in the opening section, so that it divides the opening section into a first and a second partial port only in the region adjoining the combustion space.

9. The casting mould according to claim 6, characterised in that the casting mould is designed as a sand form for a gravity casting process, wherein two transfer ports are provided in the cylinder of the two-stroke motor.

10. A casting mould for producing a transfer port in a two-stroke motor, in particular for a portable, hand-guided working device such as a motor chain saw, a motor lawnmower, a parting-off grinder or the like, with a combustion space formed in a cylinder bounded by a piston guided in the cylinder so that it performs a lifting movement, which piston drives a crankshaft rotatably mounted in a crankcase space by means of a connecting rod, comprising:

at least one transfer port which connects the crankcase space to the combustion space in predetermined piston positions in a fluidic manner, wherein the transfer port is formed at least from a combustion-space-side opening section, a rising section and a crankcase-space-side inlet section, and wherein the opening section is connected to the inlet section by the rising section arranged approximately parallel to the piston cylinder;

characterised in that the transfer port forms in the inlet section a whole port which passes in a single-flow manner into the rising section and is divided by a division at least into a first partial port and into a second partial port at least in the region of the rising section adjoining the opening section; and characterised in that forming the transfer port in the inlet section forms a whole port which passes in a single-flow manner into the rising section and is divided into a first partial port and a second partial port by a division at least in the upper region of the rising section adjoining the opening section.

11. The casting mould according to claim 10, characterised in that the upper opening section passes via a deflection region of the casting mould into the rising section, wherein the division commences in the region of the rising section adjoining the deflection region and in that the deflection region and the opening section are formed by the first and second partial ports.

12. The casting mould according to claim 10, characterised in that the division commences behind the deflection region commences in the opening section, so that it divides the opening section into a first and a second partial port only in the region adjoining the combustion space.

13. The casting mould according to claim 10, characterised in that the casting mould is designed as a sand form for a gravity casting process, wherein two transfer ports are provided in the cylinder of the two-stroke motor.

* * * * *